United States Patent [19]

Keppeler

[11] 4,028,836

[45] June 14, 1977

[54] COCKING MECHANISM FOR HAND FIREARMS

[75] Inventor: Dieter Keppeler, Langenau, Germany

[73] Assignee: Carl Walther, Sportwaffenfabrik, Ulm (Danube), Germany

[22] Filed: Apr. 7, 1976

[21] Appl. No.: 674,624

[30] Foreign Application Priority Data

Apr. 17, 1975 Germany ..... 2517002

[52] U.S. Cl. ..... 42/69 B; 89/147

[51] Int. Cl.² ..... F41C 19/14

[58] Field of Search ..... 42/69 B, 69 R, 65; 89/147

[56] References Cited

UNITED STATES PATENTS

| | | | |
|---|---|---|---|
| 2,138,213 | 11/1938 | Seidel | 42/69 B |
| 2,464,427 | 3/1949 | Wilson | 89/147 |
| 3,722,358 | 3/1973 | Seecamp | 89/147 |
| 3,863,375 | 2/1975 | Browning | 42/69 R |

*Primary Examiner*—Charles T. Jordan
*Attorney, Agent, or Firm*—Edmund M. Jaskiewicz

[57] ABSTRACT

A small firearm such as a pistol has a pivotally mounted hammer engagable with a firing pin. A trigger rod is pivotally connected to a trigger and is spring biased upwardly toward the hammer so that a notch on the trigger rod is engagable with a roller on the hammer. The notch is urged into temporary engagement with the roller during cocking of the hammer and a pin on the hammer pushes the trigger rod downwardly to disengage the notch from the roller during cocking.

1 Claim, 2 Drawing Figures

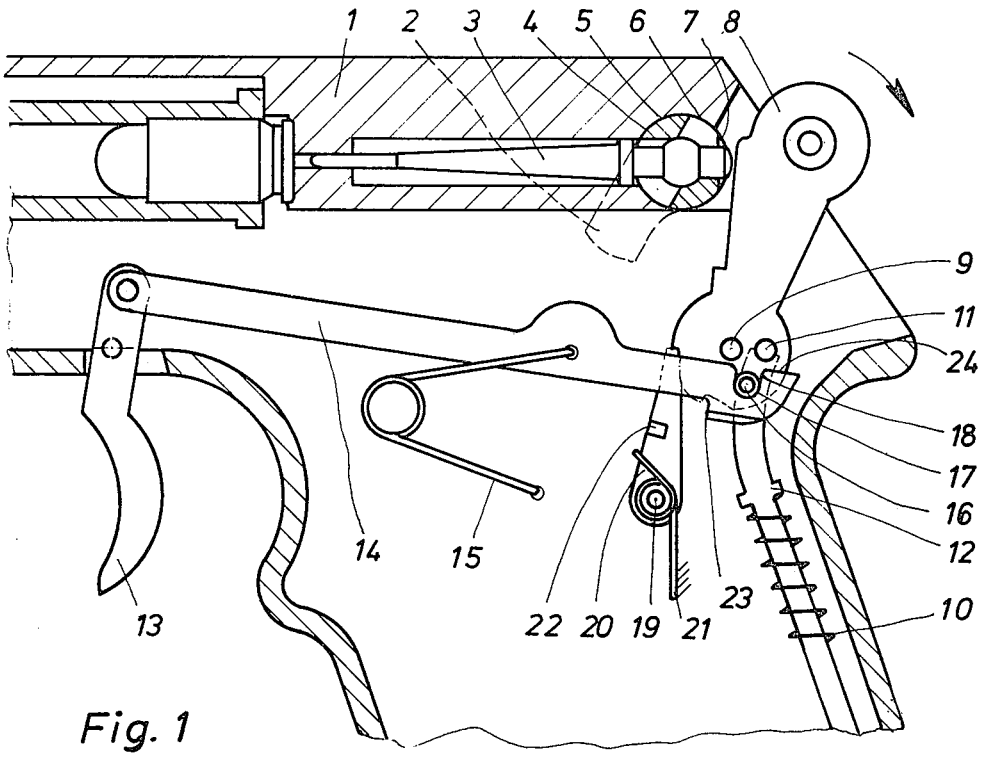
Fig. 1
Fig. 2
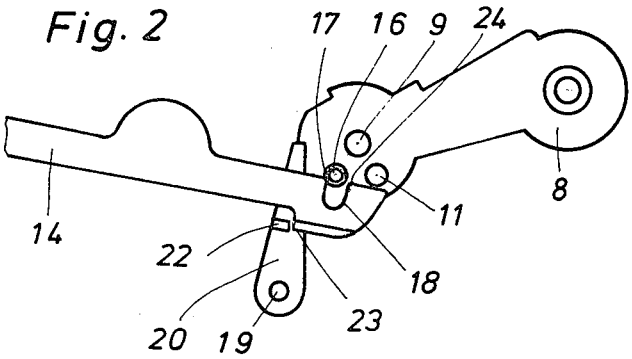

COCKING MECHANISM FOR HAND FIREARMS

The present invention relates to a trigger cocking mechanism for hand firearms, more particularly, to such a cocking mechanism wherein a trigger rod pivotally connected to the trigger is brought into direct effective operative connection with the hammer.

Cocking trigger mechanisms for hand firearms have been employed wherein the trigger rod which is pivotally connected to the trigger is brought into direct effective operative connection with the hammer in order to obtain optimum performance of the trigger. One such mechanism functions to permit the force on the trigger to be transmitted along a trigger rod pivotally connected to the trigger to act upon a cocking lever which is then transmitted to a cover or flap on the hammer itself to effect release of the hammer.

Another form of such a mechanism includes the trigger rod in the form of an extended lever which engages the hammer. However, this form of the mechanism requires that the trigger rod be provided with laterally projecting or angular projecting elements which engage notches for such a purpose which notches are provided on the hammer. From a kinematic viewpoint, this structure is disadvantageous with respect to the force transmitted from the trigger.

It is therefore the principal object of the present invention to provide a novel and improved trigger cocking mechanism for small firearms.

It is another object of the present invention to provide such a mechanism which permits the direct transmission of force from the trigger to the hammer while employing components of simple structure and which are economically feasible to produce.

It is a further object of the present invention to provide such a mechanism which in operation produces the most favorable kinematic properties.

According to one aspect of the present invention a cocking mechanism for small firearms may comprise a pivotally mounted hammer engagable with a firing pin and having a roller thereon engagable with a notch on a trigger rod which is pivotally connected to a trigger. A spring acts upon the trigger rod to urge the notch into temporary engagement with the roller during cocking of the hammer.

The hammer is further provided with a laterally projecting pin which is engagable with a surface on the trigger rod during cocking to urge the trigger rod away from the roller to disengage the notch from the roller on the hammer.

This structure has the advantage of enabling the hammer to be fabricated without the necessity of employing relatively expensive manufacturing operations such as milling and other shaping procedures. The trigger rod similarly can be manufactured as a simple and inexpensive mass produced component by stamping.

Other objects and advantages of the present invention will be apparent upon reference to the accompanying description when taken in conjunction with the following drawings, which are exemplary, wherein;

FIG. 1 shows a longitudinal sectional view through a portion of a firearm incorporating the present invention and illustrating the trigger mechanism in the uncocked state; and, FIG. 2 is a view of a portion of the mechanism of FIG. 1 and showing the trigger mechanism in the cocked position.

Proceeding next to the drawings wherein like reference symbols indicate the same parts throughout the various views a specific embodiment of the present invention will be described in detail.

In FIG. 1 there is illustrated the rear portion of a hand firearm having a breech 1 which is provided with a safety lever 2 attached to a safety shaft 4 which extends through the firearm transversely to a firing arm 3. The outer or peripheral surface of the safety shaft is indicated at 5 and is provided with blocking surfaces 6 and 7. The safety shaft 4 has an opening through which a portion of the firing pin 3 extends so that the outer end of the firing pin is exposed beyond surface 7 when the safety lever is in the release position as shown in FIG. 1.

When the safety lever 2 is moved into the locked position or counter-clockwise as viewed in FIG. 1, the outer surface 5 of the safety shaft 4 will engage a hammer 8 which is pivotally mounted at 9 to block the hammer from movement toward the firing pin. As may be seen in FIG. 1, the hammer 8 is located in a recessed area formed in the firearm.

A compression spring 10 is positioned upon a rod 12 that is pivotally connected to the hammer by a pin 11 and exerts a force on the hammer such that when the hammer is in its release position it will remain fixed in that position.

A trigger 13 is pivotally mounted in the conventional manner and the end of the trigger extending within the firearm is pivotally connected to one end of a trigger rod 14 against which a spring clip 15 acts to exert a constant tension. The other end of trigger rod 14 which is in the vicinity of hammer 8 is provided in its upper surface with a notch or recess 18 which receives a roller 17 mounted upon a pin 16 riveted upon the hammer 8. A pawl 20 is pivotally mounted on a pin 19 and spring clip 21 exerts a constant force against the pawl 20 to urge the pawl in a clockwise direction as viewed in FIG. 1 and in the direction of the hammer 8. The pawl 20 is provided with a laterally extending tab or projection 22 which is engagable with a notch or shoulder 23 formed on the underside of the trigger rod 14.

The free or upper end of the pawl 20 is also engagable with notches formed in the hammer 8 to position the hammer in the uncocked position as shown in FIG. 1 and to engage a further notch to position the hammer in the cocked position of FIG. 2.

The cocking operation may be carried out either manually after the hammer has been actuated to the uncocked position as shown in FIG. 1 or mechanically after operation of the trigger with its trigger rod pivotally connected thereto. To cock the hammer, the hammer 8 is pivoted clockwise in the direction of the arrow as shown in FIG. 1 away from the firing pin 3. During this pivoting of the hammer 8, the roller 17 will be moved out of the notch 18 and will be positioned on the upper surface of the trigger rod 14 to establish a first cocking trigger position of the hammer 8. Further pivoting of the hammer 8 in the same direction will cause the bearing pin 11 to engage the upper surface 24 of the trigger rod to depress the trigger rod downwardly against the force of the spring 15. Simultaneously with this movement of the trigger rod, the projection 22 on the pawl 21 under the action of the spring 21 will drop into notch 23 on the trigger rod 14. The upper end of the pawl 20 will be engaged with a notch on the hammer 8 to position the hammer as shown in FIG. 2.

During the firing operation, pulling the trigger 13 will cause the shoulder 23 to engage the tab 22 and thus disengage the tip of the pawl 20 from the hammer and the hammer will be moved in a direction to impact against the firing pin 3 under the action of the spring 10 and rod 12.

It is therefore apparent that the present invention has disclosed a relatively simple but effective structure of the trigger rod and hammer. This trigger rod and hammer structure will provide substantially more advantageous performance under operating conditions and the friction between moving components is reduced to a minimum during functioning of the firearm.

It will be understood that this invention is susceptible to modification in order to adapt it to different usages and conditions, and accordingly, it is desired to comprehend such modifications within this invention as may fall within the scope of the appended claims.

What is claimed is:

1. In a cocking mechanism for small firearms, the combination of a pivotally mounted hammer engagable with a firing pin and having a roller thereon, a trigger rod pivotally connected to a trigger and having a notch engagable by said hammer roller, spring means acting upon said trigger rod to urge said notch into temporary engagement with said roller during cocking of the hammer said trigger rod having a surface and said notch is in said surface, and a laterally projecting pin on said hammer and engagable with said trigger rod surface during cocking to urge said trigger rod away from said roller to disengage said notch therefrom.

* * * * *